US006117286A

United States Patent [19]

Shimamune et al.

[11] Patent Number: 6,117,286

[45] Date of Patent: Sep. 12, 2000

[54] ELECTROLYTIC CELL EMPLOYING GAS DIFFUSION ELECTRODE

[75] Inventors: Takayuki Shimamune, Tokyo; Koichi Aoki, Fukui; Masashi Tanaka, Kanagawa; Katsumi Hamaguchi, Kanagawa; Yoshinori Nishiki, Kanagawa, all of Japan

[73] Assignee: Permelec Electrode Ltd., Kanagawa, Japan

[21] Appl. No.: 09/173,686

[22] Filed: Oct. 16, 1998

[30] Foreign Application Priority Data

Oct. 16, 1997 [JP] Japan ..... 9-299563

[51] Int. Cl.[7] ..... C25B 9/10

[52] U.S. Cl. ..... 204/252; 204/263; 204/282; 204/283

[58] Field of Search ..... 204/283, 252, 204/263, 282

[56] References Cited

U.S. PATENT DOCUMENTS

| | | | |
|---|---|---|---|
| 4,604,170 | 8/1986 | Miyake et al. | 204/282 |
| 5,039,389 | 8/1991 | McMichael | 204/282 |
| 5,766,429 | 6/1998 | Shimamune et al. | 204/283 |

*Primary Examiner*—Bruce F. Bell
*Attorney, Agent, or Firm*—Sughrue, Mion, Zinn, Macpeak & Seas, PLLC

[57] ABSTRACT

A zero-gap type electrolytic cell 11 characterized as having a hydrophilic liquid-permeable material 16 interposed between an ion-exchange membrane 12 and a gas diffusion cathode 17. The reaction product passes through the liquid-permeable material and disperses toward edges of the liquid-permeable material before being withdrawn. Hence, the withdrawal direction for the target reaction product is not opposite the feed direction for the reactant gas.

28 Claims, 3 Drawing Sheets

PRIOR ART

ELECTROLYTIC CELL EMPLOYING GAS DIFFUSION ELECTRODE

FIELD OF THE INVENTION

The present invention relates to an electrolytic cell employing a gas diffusion electrode with which gas feeding can be smoothly conducted. More particularly, this invention relates to an electrolytic cell having an oxygen gas diffusion cathode which enables smooth gas feeding and thus is effective in attaining great energy savings for producing sodium hydroxide or hydrogen peroxide by electrolysis.

BACKGROUND OF THE INVENTION

The electrolysis industry represented by chlor-alkali electrolysis plays an important role as a material industry. Although the industry has such an important role, chlor-alkali electrolysis consumes a large quantity of energy. Further in this regard, energy savings is a priority in countries where the cost of energy is high, as in Japan. For example, the shift in chlor-alkali electrolysis from a mercury process using a diaphragm to an ion-exchange membrane process for the purpose of eliminating environmental problems and simultaneously attaining energy saving has attained an energy savings of about 40% over a period of about 25 years. However, even this energy savings is still insufficient, because the cost of electric power used as an energy source accounts for 50% of the total production cost. The situation has reached the stage where additional power savings cannot be attained using the current process. In order to attain further energy savings, a drastic change is necessary using, for example, electrode reactions different from conventional ones. An example thereof is the use of a gas diffusion electrode which is employed in fuel cells, etc. This is the most feasible among the currently known means and provides considerable power savings.

Gas diffusion electrodes are characterized as having the property of enabling a gas as a reactant to be easily fed to the electrode surfaces, and such electrodes have been developed for use in fuel cells, etc. Recently, investigations have begun on the utilization of gas diffusion electrodes in industrial electrolysis. For example, in an apparatus for the on-site production of hydrogen peroxide, a gas diffusion electrode has been utilized as a hydrophobic cathode for conducting an oxygen-reducing reaction (see "Industrial Electrochemistry" (2nd ed.) pp. 279-, 1991). In alkali production and various recovery processes, gas diffusion electrodes are used to conduct anodic hydrogen oxidation or cathodic oxygen reduction. This takes the place of oxygen generation at the anode or hydrogen generation at the cathode as a counter-electrode reaction so as to diminish power consumption. It has been reported that the use of a hydrogen anode as a counter electrode in metal recovery, e.g., zinc collection, or in zinc plating is effective in attaining depolarization.

However, these industrial electrolytic systems are disadvantageous in that the electrode does not have sufficient operating life or sufficient performance. This is because the composition of the solution or gas or the operating conditions are complex as compared with the case of fuel cells.

An example of a process for producing sodium hydroxide by the electrolysis of sodium chloride is explained below. Sodium hydroxide and chlorine, which both are important substances for use as industrial starting materials, are produced mainly by the electrolysis of sodium chloride. As discussed above, this electrolytic process has shifted to the ion-exchange membrane process, which employs an ion-exchange membrane as a diaphragm and an activated cathode having a low overvoltage. By using an ion-exchange membrane, the electric power consumption rate of sodium hydroxide production was reduced to 2,000 kWh per ton of sodium hydroxide. When an oxygen reduction reaction not involving hydrogen generation is conducted in place of hydrogen generation at the cathode in conventional processes, the theoretical decomposition voltage decreases from 2.19 V, which is the conventional value, to 0.96 V. Namely, a decrease in theoretical decomposition voltage of 1.23 V is possible, and great energy savings is expected.

In order for this new process to be realized industrially, it is indispensable to develop an oxygen gas diffusion cathode (a gas diffusion cathode for which oxygen is used as a feed gas) having high performance and exhibiting sufficient stability in the electrolytic system described above.

FIG. 1 shows a diagrammatic view of an electrolytic cell for sodium chloride electrolysis which employs an oxygen gas diffusion cathode of the most common type that is currently used.

This electrolytic cell 1 is partitioned into an anode chamber 3 and a cathode chamber 4 with a cation-exchange membrane 2, and the cathode chamber 4 is partitioned into a solution chamber 6 and a gas chamber 7 with an oxygen gas diffusion cathode 5. Oxygen gas as a starting material is fed from the gas chamber 7 side to the gas phase side of the oxygen gas diffusion cathode 5. The oxygen gas diffuses through the oxygen gas diffusion cathode 5 and reacts with water in the catalyst layer within the cathode 5 to generate sodium hydroxide. Consequently, the cathode used in this electrolytic process should be a gas diffusion electrode of the so-called gas/liquid separation type, which is sufficiently permeable to oxygen only and prevents sodium hydroxide from moving from the solution chamber to the gas chamber through the electrode. The oxygen gas diffusion cathodes which have been proposed so far as electrodes for sodium chloride electrolysis satisfying the above requirement are mostly gas diffusion electrodes produced by mixing carbon powder with PTFE, molding the mixture into a sheet to obtain an electrode base, and depositing a catalyst, e.g., silver or platinum, on the base.

In conventional sodium chloride electrolysis, the anodic and cathodic reactions are as follows, and the theoretical decomposition voltage is 2.19 V.

Anodic reaction: $2Cl^- \rightarrow Cl_2 + 2e$ (1.36 V)

Cathodic reaction: $2H_2O + 2e \rightarrow 4OH^- + H_2$ (−0.83 V)

When the above electrolysis is conducted while feeding oxygen to the cathode, hydrogen is consumed by the oxygen supplied to the electrolytic cell, resulting in the following cathodic reaction.

Cathodic reaction: $2H_2O + O_2 + 4e \rightarrow 4OH^-$ (0.40 V)

Therefore, a power consumption reduction of 1.23 V is theoretically possible and, even in a practical current density range, a reduction of about 0.8 V is possible. Namely, a power savings of 700 kWh per ton of sodium hydroxide is theoretically attainable. Although investigations on the practical use of gas diffusion electrodes for sodium chloride electrolysis have been made since the 1980's from the standpoint of such energy saving, these type of electrodes have the following drawbacks.

(1) The carbon used as an electrode material readily deteriorates at high temperatures in the presence of both sodium hydroxide and oxygen to considerably impair electrode performance.

(2) With an increase in liquid pressure and with electrode deterioration, it becomes difficult to prevent the sodium hydroxide thus generated from leaking into the gas chamber.

(3) It is difficult to fabricate an electrode having a size necessary for practical use (1 $mm^2$ or larger).

(4) Although the pressure within the cell changes with height, it is difficult to obtain a pressure distribution of oxygen gas that is supplied to the electrolytic cell which compensates for the pressure change.

(5) There is a solution resistance loss due to the catholyte, and power for stirring the solution is necessary.

(6) For practical use of the electrode, existing electrolytic facilities must be modified considerably.

(7) If air is utilized as an oxygen-containing gas, the gas-diffusing ability of the electrode is reduced. This is because carbon dioxide contained in the air reacts with sodium hydroxide to deposit sodium carbonate on the walls of the pores of the gas diffusion electrode.

An electrolytic process which eliminates these problems is the zero-gap electrolytic process which employs the electrolytic cell shown in FIG. 2. This electrolytic process is characterized in that the electrolytic cell 8 has an oxygen gas diffusion cathode 9 and an ion-exchange membrane 10 which are in intimate contact with each other to thereby omit the solution chamber shown in FIG. 1. Oxygen gas and water are fed as starting materials, and sodium hydroxide as a reaction product is recovered from the same side.

This electrolytic process is free from gas leakage from the solution chamber into the gas chamber. Hence, the above problem (2) is eliminated. Furthermore, because the electrolytic cell has a structure such that the electrode is in intimate contact with the ion-exchange membrane, electrolytic facilities for the conventional ion-exchange membrane process can be used without necessitating considerable modifications. Hence, the above problems (5) and (6) are also eliminated.

The performance criteria required of oxygen gas diffusion cathodes suitable for use in this electrolytic process are as follows: high gas permeability; high hydrophobicity which is necessary to avoid wetting by sodium hydroxide; and high permeability required for sodium hydroxide to move within the electrode. For attaining these requirements, the oxygen gas diffusion cathode described above is made of a durable metal, e.g., nickel or silver. Hence, the above problem (1) is eliminated and long-term electrolysis can be expected.

Furthermore, because the sodium hydroxide that is recovered in this electrolytic process permeates through the cathode into the oxygen feed side, partitioning into a solution chamber and a gas chamber with a cathode as in conventional processes is unnecessary. Consequently, no problem arises even when liquid permeates through the electrode, and electrode enlargement is thought to be relatively easy to thereby eliminate the problem (3). Because the electrolytic cell has no solution chamber and hence undergoes no liquid pressure change in the height direction, the cell is, of course, free from the problem (4). In addition, because the sodium hydroxide thus produced necessarily moves through the electrode to the oxygen feed side, the problem (7) is less apt to occur.

As described above, attempts have been intermittently made to apply gas diffusion electrodes to industrial electrolytic systems, and these attempts have succeeded in making various improvements and in providing desirable results. However, in the case where an existing electrolytic cell having a height as large as 1 m is to be utilized, even a gas diffusion electrode having the structure described above cannot provide its intrinsic electrolytic performance. Namely, gas feeding is inhibited. This is because the alkali solution which is moving toward the oxygen feed side and also the liquid which has moved gravitationally in the height direction resides within the electrode.

SUMMARY OF THE INVENTION

It is therefore an object of the present invention to provide an electrolytic cell employing a gas diffusion electrode which eliminates the problem of unsmooth gas feeding to the cathode surface as encountered in prior art techniques using a gas diffusion electrode, specifically, the zero-gap type electrolysis of sodium chloride or the zero-gap type electrolysis for hydrogen peroxide production where an oxygen gas diffusion electrode disposed in intimate contact with an ion-exchange membrane is used to conduct electrolysis, and which electrolytic cell is capable of yielding sodium hydroxide, hydrogen peroxide, etc. at a low electrolytic voltage.

The present invention solves the above problems of the prior art by providing an electrolytic cell employing a gas diffusion electrode, which comprises an ion-exchange membrane partitioning the electrolytic cell into an anode chamber including an anode electrode and a cathode chamber including a gas diffusion cathode as the gas diffusion electrode, said electrolytic cell further comprising a hydrophilic liquid-permeable material interposed between the ion-exchange membrane and the gas diffusion cathode.

BRIEF DESCRIPTION OF THE DRAWINGS

FIG. 4(*a*) shows an example containing a cathode composed of two or more parts, and FIG. 4(*b*) shows an example containing a cathode having one or more slits formed therein.

Figure 1:
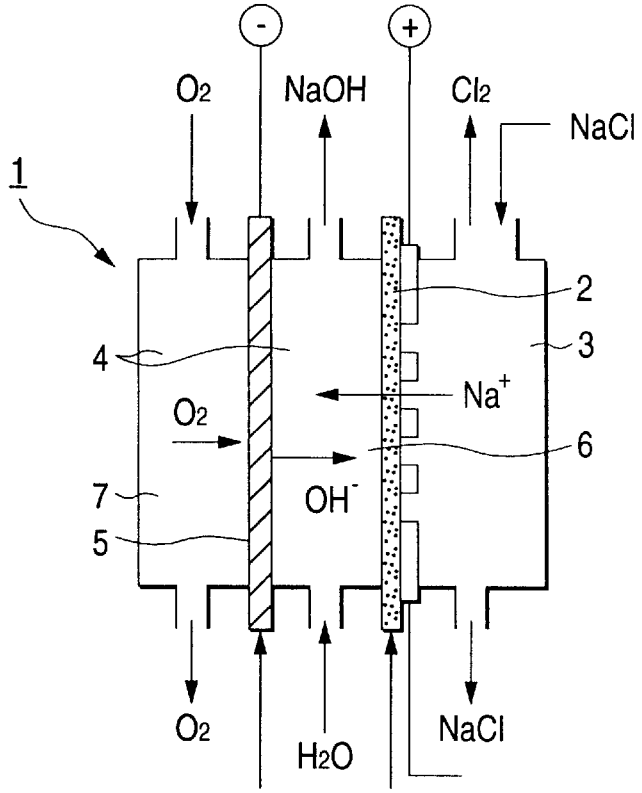
FIG. 1 is a diagrammatic view illustrating an example of a conventional electrolytic cell for sodium chloride electrolysis.

In the drawings, 11 is an electrolytic cell main body, 12 is an ion-exchange membrane, 13 is an anode chamber, 14 is a cathode chamber, 15 is an insoluble anode, 16 is a hydrophilic material, 17 is an oxygen gas diffusion cathode and 18 is a collector.

DETAILED DESCRIPTION OF THE INVENTION

The application of oxygen gas diffusion cathodes to industrial electrolysis, e.g., sodium chloride electrolysis, is known, and reports have been made thereon. In electrolytic cells of the type in which the cathode chamber is partitioned into a solution chamber and a gas chamber containing an oxygen gas diffusion cathode, the liquid resistance caused by the liquid present between the ion-exchange membrane and the cathode is too high to be disregarded.

Zero-gap type electrolysis, in which the ion-exchange membrane is in intimate contact with the cathode, is a technique which has been developed for reducing the liquid resistance. In the case of sodium chloride electrolysis, for example, the aforementioned cathodic reaction represented by $2H_2O+2e \rightarrow 4OH^- + H_2$ occurs at the interface between the ion-exchange membrane and the cathode, and the sodium hydroxide thus generated permeates as a solution through the oxygen gas diffusion cathode and is removed from the gas phase side of the cathode. Because the flow direction of the sodium hydroxide is opposite that of the oxygen-containing gas in this case, the solution accumulates in the oxygen diffusion electrode or the gas feed rate becomes low.

It is known that the increase in electrolytic voltage with increasing current density in the case of using an oxygen gas diffusion cathode for sodium chloride electrolysis, for example, is about 1.5 to 2 times that in the case of using a gas-generating electrode for sodium chloride electrolysis. This effect is thought to be attributable to the characteristics of oxygen gas diffusion cathodes. Namely, it has been found that the main causes thereof are attributable not to the kinds of reactions but to overvoltage due to reasons other than the electrode reactions. One of the causes of the increase in overvoltage is the insufficiency of gas supply to the oxygen gas diffusion cathode. In the case of sodium chloride electrolysis, for example, it is known that the use of air as a feed gas results in an overvoltage higher by about 200 mV than that resulting from the use of pure oxygen as a feed gas. Although increasing the feed amount of a gas results in a reduced overvoltage, the increased gas feed amount makes it difficult to remove the reaction product, finally resulting in unsmooth gas feeding.

Another object of the present invention is to provide an electrolytic cell from which a solution containing the reaction product can be removed smoothly and to which an oxygen-containing gas can be fed smoothly. By achieving these objectives, an industrial electrolytic cell employing an oxygen gas diffusion cathode can be realized.

The electrolytic cell of the present invention, which is an improvement of the zero-gap type cell containing an ion-exchange membrane and an oxygen gas diffusion cathode disposed in intimate contact with each other, is characterized in that a hydrophilic liquid-permeable material is disposed between the ion-exchange membrane and the oxygen gas diffusion cathode. This hydrophilic liquid-permeable material allows part or all of a solution of the sodium hydroxide or hydrogen peroxide which has been generated on the ion-exchange membrane to permeate therethrough, and enables the solution to be removed from the cathode chamber through the periphery, in particular a lower part thereof. Namely, the liquid-permeable material reduces the time which the solution resides between the ion-exchange membrane and the oxygen gas diffusion cathode. This in turn enables an oxygen-containing gas to be smoothly fed to the oxygen gas diffusion cathode from the back side thereof. Consequently, according to the present invention, the smooth withdrawal of a solution of the reaction product and the smooth feeding of oxygen gas, which are operations in different directions, can be conducted at maximum efficiency to attain an electrolytic voltage lower than in a conventional apparatus. Thus, the present invention allows for the application of oxygen gas diffusion cathodes to industrial electrolysis.

From the standpoint of liquid resistance and electrolysis voltage, a hydrophilic liquid-permeable material would not be interposed between the ion-exchange membrane and the oxygen gas diffusion cathode. However, except for the case where the ion-exchange membrane is utilized as a solid electrolyte as in the electrolysis of pure water, there is no need to dispose the ion-exchange membrane so as to be in intimate contact with the cathode. However, the present inventors surprisingly discovered that interposing the hydrophilic liquid-permeable material provides a different effect which more than compensates for the increase in electrolytic voltage, such that the electrolytic system as a whole can achieve energy savings.

Namely, the present invention is characterized in that the solution is removed through a hydrophilic liquid-permeable material to thereby attain smooth gas feeding and thus reduce the electrolytic voltage by a value not smaller than the increase resulting from interposing the hydrophilic liquid-permeable material. Thus, the electrolytic system as a whole attains an energy savings.

If the hydrophilic liquid-permeable material is a continuous liquid layer, this liquid layer has, along the height direction, a pressure gradient imposed on the oxygen gas diffusion cathode, and this pressure gradient may be an obstacle to size enlargement. In the present invention, however, the oxygen gas diffusion cathode does not undergo a pressure change in the height direction. This is because the cathode chamber has no solution chamber and the same gas pressure is hence applied on the whole back side of the oxygen gas diffusion cathode. Also, a solution of the reaction product is removed substantially as droplets from the hydrophilic liquid-permeable material, and it is proper to consider that the liquid present within the hydrophilic liquid-permeable material does not constitute a continuous liquid layer but rather a discontinuous liquid film.

The oxygen gas diffusion cathode for use in the present invention may have the characteristics of conventional oxygen gas diffusion cathodes. For example, a gauze, sintered powder, sintered metal fiber, foamed object, etc., made of a corrosion-resistant material such as, e.g., titanium, niobium, tantalum, stainless steel, nickel, zirconium, carbon, or silver can be used as an electrode substrate, optionally after having been cleaned in a pretreatment. It is preferred to impart moderate porosity and electroconductivity to this electrode substrate so as to smoothly conduct the feeding and removal of electric current and also of the gas and liquid.

A catalyst layer is desirably formed on the surface of the electrode substrate. The catalyst can be made of a metal such as, e.g., platinum, palladium, ruthenium, iridium, copper, silver, cobalt, or lead or an oxide of any of these metals. A layer of the catalyst can be formed by mixing a catalyst material powder with a binder, e.g., a fluororesin, and a solvent, e.g., naphtha, depositing the resultant paste on the substrate, and solidifying the deposit, or by applying a solution of a salt of a catalyst metal on the substrate surface and burning the coating, or by subjecting the substrate to electroplating in the salt solution or to electroless plating in the salt solution in the presence of a reducing agent.

In order to allow the reactant gas to move speedily, a hydrophobic material is preferably deposited in a dispersed manner on the electrode substrate or a collector. Desirable examples of the hydrophobic material include pitch fluoride, graphite fluoride, and fluororesins. In particular, in the case of using fluororesins, heating is preferably conducted at a temperature of from 200 to 400° C. in order to obtain even and satisfactory performance. The fluorinated ingredients are preferably used as a powder having a particle diameter of from 0.005 to 100 $\mu$m. The electrode substrate thus treated preferably has hydrophobic areas and hydrophilic areas, each of which is continuous along the direction of a section of the electrode.

From the standpoints of corrosion resistance and economy, the electrode substrate is desirably plated with a noble metal, especially silver. A hydrophobic silver plating bath is prepared, for example, by preparing an aqueous solution of 10–50 g/l silver thiocyanide and 200–400 g/l potassium thiocyanide, and adding thereto PTFE particles and a surfactant in amounts of 10–200 g/l and 10–200 g/(g/PTFE), respectively. Electrodeposition is conducted with adequate stirring at room temperature and a current density of from 0.2 to 2 A/dm$^2$. When the deposit has a thickness of from 1 to 300 $\mu$m, the electrode substrate exhibits satisfactory hydrophobicity and satisfactory corrosion resistance. After plating, the substrate is preferably washed sufficiently with acetone, etc.

The hydrophilic material interposed between the ion-exchange membrane and the gas diffusion cathode in the present invention is preferably a porous structure comprising a corrosion-resistant metal or resin. This hydrophilic material need not have electroconductivity because it does not contribute to electron movement. Examples of the hydrophilic material include carbon, ceramics such as zirconium oxide and silicon carbide, hydrophilized resins such as PTFE and EEP, metals such as nickel, stainless steel, and silver, and alloys of such metals. The hydrophilic material is preferably in the form of a sheet having a thickness of from 0.01 to 10 mm. Because the hydrophilic material is interposed between the membrane and the cathode, it is desirably an elastic material which, when pressure unevenness is present, deforms to absorb the pressure. Furthermore, the hydrophilic material preferably is made of such a material, and has a structure which can hold a catholyte. Examples of such structures include nets, woven fabrics, nonwoven fabrics and foamed objects. Especially preferred is a sintered plate obtained by mixing a powdery starting material with a pore-forming agent and any of various binders, molding the mixture into a sheet, removing the pore-forming agent with a solvent, and then sintering the sheet, or a structure composed of such sintered plates superposed on each other. An appropriate range of the pore diameter of this hydrophilic material is from 0.01 to 10 mm.

In a preferred embodiment, the hydrophilic material is interposed between the ion-exchange membrane and an oxygen gas diffusion cathode by sandwiching the hydrophilic material between the ion-exchange membrane and the cathode and uniting these members by applying thereto a pressure of about 0.1 to 30 kgf/cm$^2$, which corresponds to the water pressure difference due to the height of the anolyte. It is also possible to form the hydrophilic material on the membrane side surface of the cathode or on the cathode side surface of the ion-exchange membrane, before the ion-exchange membrane and the cathode are brought into intimate contact with each other and disposed in a predetermined position.

In the case where the electrolytic cell of the present invention is used for sodium chloride electrolysis, the ion-exchange membrane preferably comprises a fluororesin membrane from the standpoint of corrosion resistance. The anode is desirably an ordinary insoluble titanium electrode called a DSA. However, other electrodes can be used.

Electrolysis conditions include, for example, a temperature of from 60 to 90° C. and a current density of from 10 to 100 A/dm$^2$. If desired and necessary, the oxygen-containing feed gas is humidified. In a humidification method, a humidifier heated to 70 to 95° C. is disposed at an inlet to the electrolytic cell, and the oxygen-containing gas is passed through the humidifier to thereby control the humidity thereof. In view of the performance of commercially available membranes, the oxygen-containing gas need not be humidified when the concentration of the anolyte is regulated to 200 g/l or lower, especially 170 g/l is lower. Although the concentration of sodium hydroxide resulting from the electrolysis is desirably about from 25 to 40 wt %, it is basically determined by the performance of the ion-exchange membrane that is selected.

When the electrolytic cell of the present invention is used to conduct sodium chloride electrolysis, sodium hydroxide generates mainly around the surface of the oxygen gas diffusion cathode which faces the ion-exchange membrane, and this sodium hydroxide can be withdrawn through the hydrophilic material, namely, without going through the oxygen gas diffusion cathode. If the hydrophilic material used in this electrolysis is in the form of a sheet, the sodium hydroxide cannot be withdrawn until it reaches the edge of the sheet. In this case, a relatively large amount of time may be required before the sodium hydroxide is withdrawn. This problem can be eliminated in the present invention by the following means. For example, the sheet is divided into two or more pieces. An oxygen gas diffusion cathode having one or more slits or guides having a width of, e.g., from 1 to 5 mm is used, and the sheet pieces are disposed so that they extend respectively through these gaps and one end of each sheet piece reaches the back side of the electrode. This structures allows the sodium hydroxide thus generated to be withdrawn from the interface between the ion-exchange membrane and the oxygen gas diffusion cathode in a short time period without reaching the edge of the sheet.

Figure 3:
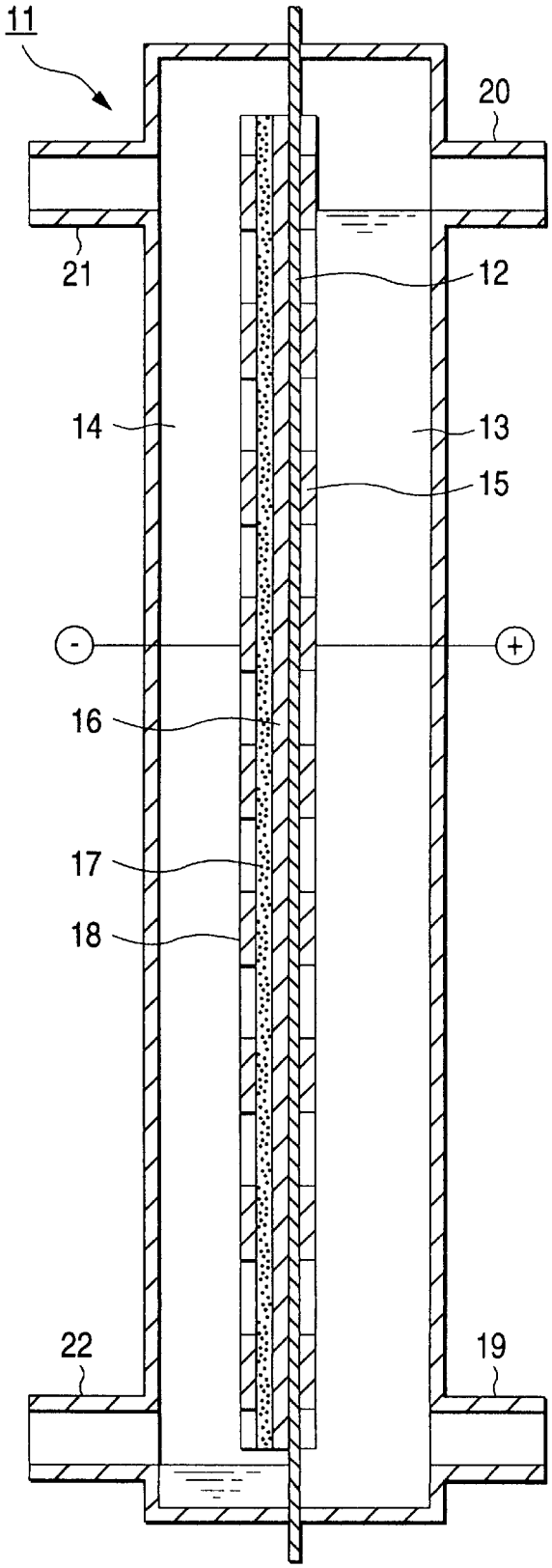
FIG. 3 is a vertical sectional view illustrating one embodiment of the electrolytic cell for sodium chloride electrolysis employing an oxygen gas diffusion cathode according to the present invention.

FIG. 3 is a vertical sectional view illustrating one embodiment of the electrolytic cell for sodium chloride electrolysis employing an oxygen gas diffusion cathode according to the present invention.

The electrolytic cell main body 11 is partitioned into an anode chamber 13 and a cathode chamber 14 with an ion-exchange membrane 12. The cell has a mesh-form insoluble anode 15 in intimate contact with the ion-exchange membrane 12 on the anode chamber 13 side thereof, and has a sheet-form hydrophilic material 16 in intimate contact with the ion-exchange membrane 12 on the cathode chamber 14 side thereof. The cell further has a liquid-permeable oxygen gas diffusion cathode 17 in intimate contact with the hydrophilic material 16 on the cathode chamber side thereof. A mesh-form cathode collector 18 is connected to the oxygen gas diffusion cathode 17 so that electricity is supplied through the collector 18.

Numeral 19 denotes an anolyte (saturated aqueous sodium chloride solution) inlet formed in a side wall part near the bottom of the anode chamber; 20 denotes an outlet for the anolyte (aqueous solution of unreacted sodium chloride) and chlorine gas formed in a side wall part near the top of the anode chamber; 21 denotes an inlet for a (humidified) oxygen-containing gas formed in a side wall part near the top of the cathode chamber; and 22 denotes an outlet for sodium hydroxide and excess oxygen formed in a side wall part near the bottom of the cathode chamber.

When current is passed through the electrodes 15 and 16 of this electrolytic cell 11 while feeding saturated aqueous sodium chloride solution as an anolyte to the anode chamber 13 and feeding a humidified oxygen-containing gas, e.g., pure oxygen or air, to the cathode chamber 14, sodium hydroxide generates on the surface of the ion-exchange membrane 12 which faces the cathode chamber 14. In an ordinary electrolytic cell, this sodium hydroxide permeates as an aqueous solution through the oxygen gas diffusion cathode and then reaches the surface thereof on the cathode chamber side. In the electrolytic cell 11 shown in FIG. 3, however, the hydrophilic material 16 is present between the ion-exchange membrane 12 and the oxygen gas diffusion cathode 17. Consequently, the aqueous sodium hydroxide solution thus generated dispersedly descends especially due to gravity within the hydrophilic material 16, in which case the solution encounters a lower flow resistance than in the cathode 17. The solution thus reaches the lower edge of the hydrophilic material 16, drips as droplets onto the bottom of the cathode chamber 14, and is stored therein.

Figure 2:
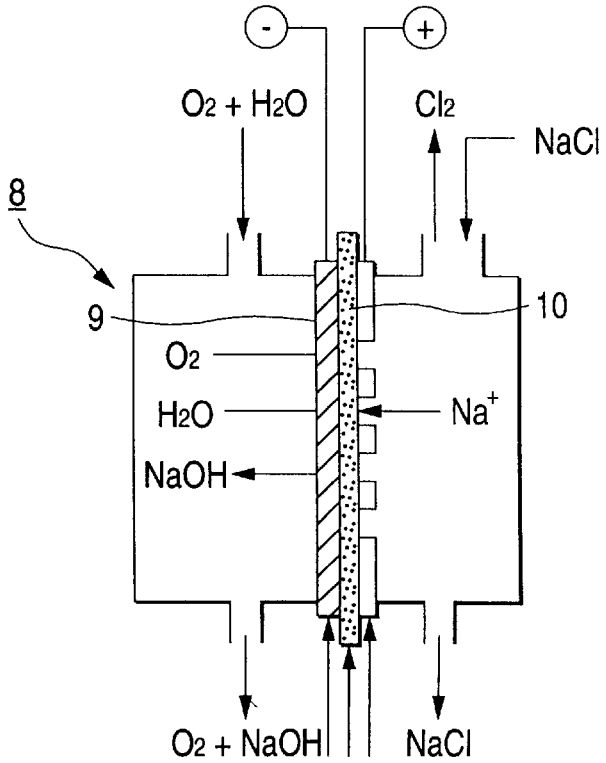
PRIOR ART FIG. 2
FIG. 2 is a diagrammatic view illustrating another example of a conventional electrolytic cell for sodium chloride electrolysis.

This electrolytic cell is compared, for example, to a conventional electrolytic cell as shown in FIG. 2. In the conventional electrolytic cell shown in FIG. 2, the aqueous sodium hydroxide solution thus generated permeates through the highly dense oxygen gas diffusion cathode and hence resides in the electrode for a prolonged period of time. This impedes the oxygen-containing feed gas from smoothly permeating through the electrode. As a result, the gas feeding, which determines the reaction rate, becomes insufficient. Consequently, the generation of sodium hydroxide becomes insufficient and the reaction efficiency decreases considerably. In contrast, in the electrolytic cell shown in FIG. 3, withdrawal of the aqueous sodium hydroxide solution thus generated from the reaction sites proceeds based on dispersion of the solution within the hydrophilic material having a relatively low flow resistance. Thus, the solution hardly resides in the cathode. Consequently, the reactant gas can be supplied in a smooth manner and hence, a high reaction efficiency is maintained.

Figure 4:
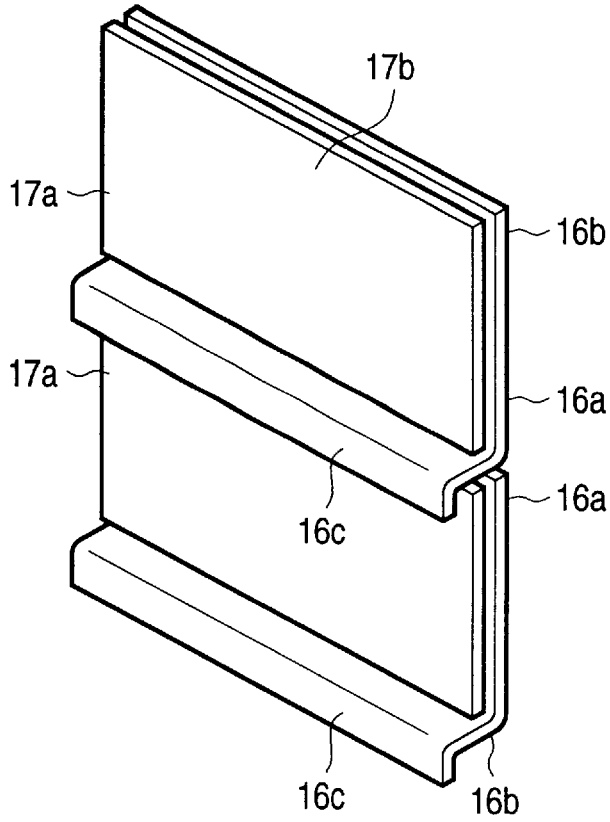
FIGS. 4(*a*) and 4(*b*) are vertical sectional views illustrating another embodiment of the electrolytic cell for sodium chloride electrolysis employing an oxygen gas diffusion cathode according to the present invention.
Figure 4:
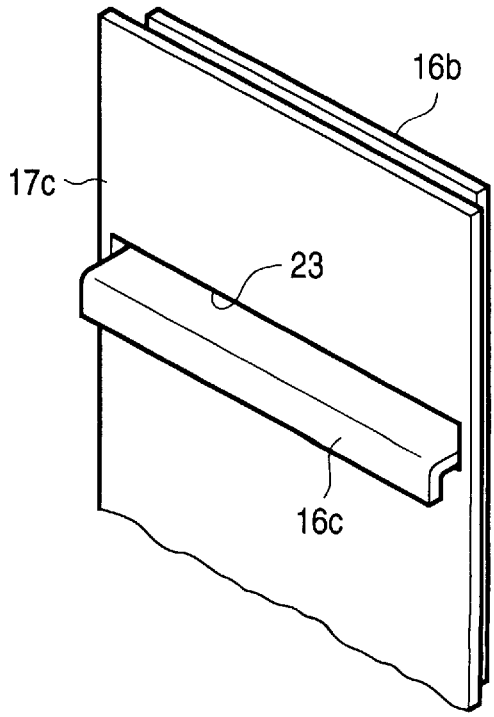

FIGS. 4(*a*) and 4(*b*) are slant views of important parts of an electrolytic cell which is an improvement of the cell shown in FIG. 3 and with which the aqueous sodium hydroxide solution thus produced can be removed more smoothly. FIG. 4(*a*) shows an example of a cathode composed of two or more parts, and FIG. 4(*b*) shows an example of a cathode having one or more slits formed therein.

The oxygen gas diffusion cathode 17*a* shown in FIG. 4(*a*) is divided into cathode pieces 17(*b*), and the hydrophilic liquid-permeable material 16*a* has also been divided into the same number of liquid-permeable material pieces 16*b*. The lower edge of each liquid-permeable material piece 16*b* is bent toward the cathodes 17*b* so that the bent part extends through the space between the upper and lower adjacent cathodes 17*b* and reaches the back side thereof to form a bent piece 16*c*.

When this electrolytic cell is used to conduct electrolysis, the aqueous sodium hydroxide solution generated on the surface of the ion-exchange membrane facing the cathode chamber permeates through the hydrophilic liquid-permeable material pieces 16*b* as in the case of the electrolytic cell shown in FIG. 3. Because the liquid-permeable material 16*b* is divided into sections, the aqueous sodium hydroxide solution only needs to move to the edge of each section. Namely, the solution moves through each liquid-permeable material piece 16*b* to the lower edge thereof over relatively short distances, and then drips as droplets from each bent piece 16*c* bent toward the cathodes 17*b*. Therefore, liquid withdrawal can be conducted more smoothly than in the electrolytic cell shown in FIG. 3.

FIG. 4(*b*) shows a cathode 17*c* which has not been divided into pieces. This cathode 17*c* has one or more horizontally long, rectangular slits 23. The cathode which has been divided into two or more pieces as shown in FIG. 4(*a*) necessitates power feeding with respect to each piece and this is troublesome. In contrast, when the cathode 17*c* having one or more slits 23 is used and the bent piece 16*c* of each liquid-permeable material piece 16*b* is inserted into the corresponding slit 23 and positioned on the back side of the cathode as shown in FIG. 4(*b*), then power feeding to the cathode can be conducted through a single collector. Hence, the construction shown in FIG. 4(*b*) is more advantageous.

The present invention will be explained below in more detail by reference to the following Examples in which electrolytic cells according to the present invention were used to conduct electrolysis. However, these Examples should not be construed as limiting the scope of the invention.

EXAMPLE 1

A foamed silver article having a thickness of 1 mm was used as a cathode substrate (projected electrolysis area, 1.25 $dm^2$; width, 5 cm; height, 25 cm; thickness 0.5 mm). A suspension prepared by mixing an ultrafine powder of silver (500 Å, manufactured by Shinku Yakin K.K.) with an aqueous PTFE suspension (30J, manufactured by Mitsui Fluorochemical Co., Ltd.) in a ratio of 1:1 by volume was applied to the substrate in an amount of 500 $g/m^2$. The coating was burned at 350° C. for 50 minutes in an electric furnace.

A nickel mesh (thickness, 2 mm; percentage of openings, 40%; opening diameter, 5 mm) which had undergone silver plating in a plating bath containing 30 g/l silver chloride, 300 g/l ammonium thiocyanide and 20 g/l boric acid was connected as a collector to the cathode substrate to obtain an oxygen gas diffusion cathode.

A dimensionally stable electrode (DSE) which was porous and made of titanium was used as an anode, and Nafion 962 (manufactured by E.I. du Pont de Nemours & Co.) was used as an ion-exchange membrane. A sintered fiber sheet having a height of 25 cm, width of 5 cm, and thickness of 1 mm and made of silver was interposed as a hydrophilic liquid-permeable material between the oxygen gas diffusion cathode and the ion-exchange membrane. The anode was brought into intimate contact with the ion-exchange membrane, and the hydrophilic liquid-permeable material was vertically fixed to constitute an electrolytic cell (the hydrophilic liquid-permeable material had a thickness of 0.5 mm after fixing).

Saturated aqueous sodium chloride solution having a concentration of 180 g/l was supplied as an anolyte at a rate of 4 ml/min, while humidified oxygen gas was supplied to the oxygen gas diffusion cathode at a rate of 200 ml/min, which was 1.5 times the theoretical amount. Electrolysis was conducted at a temperature of 90° C. and a current amount of 37.5 A while controlling the concentration of sodium hydroxide. As a result, the electrolytic voltage was 2.10 V, and a 32 wt % sodium hydroxide solution was obtained through the cathode outlet at a current efficiency of 96%. This electrolysis was continued for 80 days. As a result, the electrolysis voltage increased by 20 mV but the current efficiency was maintained at 95%.

COMPARATIVE EXAMPLE 1

Electrolysis was conducted under the same conditions as in Example 1, except that the hydrophilic liquid-permeable material interposed between the ion-exchange membrane and the oxygen gas diffusion cathode was omitted. As a result, the electrolytic voltage was 2.35 V.

EXAMPLE 2

The same electrolytic cell as in Example 1 was constructed, except that a graphitized carbon cloth having a thickness of 1 mm (manufactured by Nippon Carbon Co., Ltd.) was used as a hydrophilic liquid-permeable material. Two sheets of this cloth superposed on each other were interposed between the ion-exchange membrane and the oxygen gas diffusion cathode (the hydrophilic liquid-permeable layer had a thickness of 0.4 mm after fixing). Electrolysis was conducted under the same conditions as in Example 1. As a result, the electrolytic voltage was 2.15 V, and a 32 wt % sodium hydroxide solution was obtained through the cathode outlet at a current efficiency of 96%.

EXAMPLE 3

The same electrolytic cell as in Example 2 was used, except that the width and height of the cell were changed to 10 cm and 100 cm, respectively. Electrolysis was conducted at a temperature of 90° C. and a current of 300 A while supplying saturated aqueous sodium chloride solution as an anolyte at a rate of 250 ml/min and supplying humidified pure oxygen gas to the cathode at a rate of 2 l/min, which was 2 times the theoretical amount. As a result, the electrolytic voltage was 2.25 V, and a 32 wt % sodium hydroxide solution was obtained through the cathode outlet at a current efficiency of 98%.

COMPARATIVE EXAMPLE 2

Electrolysis was conducted under the same conditions as in Example 3, except that the hydrophilic liquid-permeable layer interposed between the ion-exchange membrane and the oxygen gas diffusion cathode was omitted, and that the current density was changed to 10 A/dm$^2$ (100 A). As a result, the electrolytic voltage was 2.4 V and the generation of hydrogen gas was observed.

EXAMPLE 4

The same electrolytic cell as in Example 2 was used, except that the width and height of the cell were changed to 10 cm and 100 cm, respectively. Also, 3-mm slits were formed in the carbon cloth as a hydrophilic liquid-permeable material at an interval of 20 cm, and one end of each cloth was hung on the back side of the cathode. A current of 300 A was passed through the electrolytic cell. As a result, the electrolytic voltage was 2.15 V.

COMPARATIVE EXAMPLE 3

Electrolysis was conducted under the same conditions as in Example 4, except that the hydrophilic liquid-permeable layer was omitted. As a result, the electrolytic voltage was 2.35 V.

The electrolytic cell employing a gas diffusion electrode of the present invention is partitioned with an ion-exchange membrane into an anode chamber and a cathode chamber including a gas diffusion cathode as the gas diffusion electrode and is used for electrolysis while feeding an anolyte and a cathode gas to the anode chamber and the cathode chamber, respectively. The electrolytic cell further comprises a hydrophilic liquid-permeable material interposed between the ion-exchange membrane and the gas diffusion cathode.

In conventional electrolytic cells employing a gas diffusion cathode, in particular in a zero-gap type electrolytic cell employing a gas diffusion electrode disposed in intimate contact with an ion-exchange membrane, the target reaction product produced on the surface of the ion-exchange membrane facing the cathode chamber must permeate through the gas diffusion cathode, which has a relatively high density, in a direction opposite the feed direction of the reactant gas. In other words, the reaction product permeates through the gas diffusion cathode while inhibiting the supply of the reactant gas. Hence, there has been a problem in that the larger the amount of the reaction product, the more that the reactant gas supply to the reaction sites is inhibited, resulting in lower reaction efficiencies.

In contrast, in the electrolytic cell of the present invention, which has a hydrophilic liquid-permeable material interposed between the oxygen gas diffusion cathode and the ion-exchange membrane, the reaction product such as sodium hydroxide is removed from the ion-exchange membrane surface not through the oxygen gas diffusion cathode but rather through the liquid-permeable material in a direction not opposite the feed direction of the reactant gas. That is, in the electrolytic cell of the present invention, smooth reactant-gas feeding which directly influences the reaction efficiency, and smooth reaction-product withdrawal, which ordinarily are conflicting operations, can each be carried out at the same time to thereby produce a target reaction product at high efficiency. However, these two conflicting operations cannot be efficiently carried out by a conventional technique. Rather, almost all of the reaction product in conventional electrolytic cells is removed through the oxygen gas diffusion cathode. Therefore, even when the reaction product is produced in an increased amount in accordance with the present invention, this exerts almost no influence on the supply of the reactant gas, and the given electrolysis reactions can be continued while maintaining a high reaction efficiency.

For use in the electrolysis of sodium chloride, the hydrophilic liquid-permeable material, which is porous, is desirably made of a material resistant to the sodium hydroxide that is produced, e.g., a ceramic, resin, or metal.

The electrolytic cell of the present invention can be used for the production of sodium hydroxide by sodium chloride electrolysis or the production of hydrogen peroxide. In either electrolytic process, a reactant gas can be smoothly supplied as described above, thereby attaining improved reaction efficiency.

While the invention has been described in detail and with reference to specific embodiments thereof, it will be apparent to one skilled in the art that various changes and modifications can be made therein without departing from the spirit and scope thereof.

What is claimed is:

1. An electrolytic cell employing a gas diffusion electrode, which comprises an ion exchange membrane partitioning the electrolytic cell into an anode chamber including an anode and a cathode chamber including a gas diffusion cathode, said electrolytic cell further comprising a hydrophilic liquid-permeable material distinct from the gas diffusion cathode and having a thickness of from 0.01 to 10 mm, said hydrophilic liquid-permeable material being interposed between the ion-exchange membrane and the gas diffusion cathode.

2. The electrolytic cell of claim 1, wherein the hydrophilic liquid-permeable material is porous and comprises an alkali-resistant material.

3. The electrolytic cell of claim 1, wherein said hydrophilic liquid-permeable material has opposing surfaces in intimate contact with a surface of the gas diffusion cathode and a surface of the ion-exchange membrane, respectively.

4. The electrolytic cell of claim 1, wherein said hydrophilic liquid-permeable material is non-electroconductive.

5. The electrolytic cell of claim 4, wherein the non-electroconductive hydrophilic liquid-permeable material is selected from the group consisting of carbon, ceramics, silicon carbide and hydrophilized resins.

6. The electrolytic cell of claim 1, wherein the hydrophilic liquid-permeable material is catalytically inactive.

7. An electrolytic cell for sodium hydroxide production employing a gas diffusion electrode, which comprises an ion-exchange membrane partitioning the electrolytic cell into an anode chamber including an anode and a cathode chamber including a gas diffusion cathode for producing by electrolysis chlorine gas and sodium hydroxide in the anode chamber and the cathode chamber, respectively, said electrolytic cell further comprising a hydrophilic liquid-permeable material distinct from the gas diffusion cathode and having a thickness of from 0.01 to 10 mm, said hydrophilic liquid-permeable material being interposed between the ion-exchange membrane and the gas diffusion cathode.

8. The electrolytic cell of claim 1, further comprising an inlet for supplying an electrolyte to the anode chamber and an inlet for supplying an oxygen-containing gas to the cathode chamber.

9. The electrolytic cell of claim 7, further comprising an inlet for supplying an electrolyte to the anode chamber and an inlet for supplying an oxygen-containing gas to the cathode chamber.

10. The electrolytic cell of claim 7, wherein said hydrophilic liquid-permeable material has opposing surfaces in intimate contact with a surface of the gas diffusion cathode and a surface of the ion-exchange membrane, respectively.

11. The electrolytic cell of claim 7, wherein the hydrophilic liquid-permeable material is porous, and comprises an alkali-resistant material.

12. The electrolytic cell of claim 7, wherein the hydrophilic liquid-permeable material is non-electroconductive.

13. The electrolytic cell of claim 12, wherein the non-electroconductive hydrophilic liquid-permeable material is selected from the group consisting of carbon, ceramics, silicon carbide and hydrophilized resins.

14. The electrolytic cell of claim 7, wherein the hydrophilic liquid-permeable material is catalytically inactive.

15. An electrolytic cell employing a gas diffusion electrode, which comprises an ion-exchange membrane partitioning the electrolytic cell into an anode chamber including an anode and a cathode chamber including a gas diffusion cathode having a front side and a backside, said electrolytic cell further comprising a hydrophilic liquid-permeable material interposed between the ion-exchange membrane and the front side of the gas diffusion cathode, wherein said gas diffusion cathode is divided into two or more upper and lower sections forming a space between adjacent sections, the hydrophilic liquid-permeable material is divided into two or more sections, and an edge of at least one of said liquid-permeable material sections extends through a space between one of said upper and lower adjacent sections to reach the backside of said gas diffusion cathode.

16. The electrolytic cell of claim 15, wherein a lower edge of at least one of said hydrophilic liquid-permeable sections extends through one of said spaces to reach the backside of said gas diffusion cathode.

17. The electrolytic cell of claim 16, wherein a lower edge of at least one of said liquid-permeable material sections extending through one of said spaces comprises a bent portion bent toward the gas diffusion cathode.

18. The electrolytic cell of claim 15, wherein said hydrophilic liquid-permeable material has opposing surfaces in intimate contact with a surface of the gas diffusion cathode and a surface of the ion-exchange membrane, respectively.

19. The electrolytic cell of claim 15, wherein the hydrophilic liquid-permeable material is porous, has a thickness of from 0.01 to 10 mm, and comprises an alkali-resistant material.

20. The electrolytic cell of claim 15, wherein the hydrophilic liquid-permeable material is distinct from the gas diffusion cathode and has a thickness of from 0.01 to 10 mm.

21. An electrolytic cell employing a gas diffusion electrode, which comprises an ion-exchange membrane partitioning the electrolytic cell into an anode chamber including an anode and a cathode chamber including a gas diffusion cathode having a front side and a backside, said electrolytic cell further comprising a hydrophilic liquid-permeable material interposed between the ion-exchange membrane and the front side of the gas diffusion cathode, wherein the gas diffusion cathode comprises one or more slits, the hydrophilic liquid-permeable material is divided into two or more sections, and an edge of at least one of said hydrophilic liquid-permeable sections extends through one of said slits to reach the backside of said gas diffusion cathode.

22. The electrolytic cell of claim 21, wherein said hydrophilic liquid-permeable material is divided into two or more sheets and said gas diffusion cathode is in the form of a single sheet having one or more slits.

23. The electrolytic cell of claim 21, wherein said one or more slits comprise horizontally long, rectangular slits.

24. The electrolytic cell of claim 21, wherein a lower edge of at least one of said hydrophilic liquid-permeable sections extends through one of said slits to reach the backside of said gas diffusion cathode.

25. The electrolytic cell of claim 24, wherein a lower edge of at least one of said liquid-permeable material sections extending through one of said slits comprises a bent portion bent toward the gas diffusion cathode.

26. The electrolytic cell of claim 21, wherein said hydrophilic liquid-permeable material has opposing surface in intimate contact with a surface of the gas diffusion cathode and a surface of the ion-exchange membrane, respectively.

27. The electrolytic cell of claim 21, wherein the hydrophilic liquid-permeable material is porous, has a thickness of from 0.01 to 10 mm, and comprises an alkali-resistant material.

28. The electrolytic cell of claim 21, wherein the hydrophilic liquid-permeable material is distinct from the gas diffusion cathode and has a thickness of from 0.01 to 10 mm.

* * * * *